US005752721A

United States Patent [19]

Balbas

[11] Patent Number: 5,752,721

[45] Date of Patent: May 19, 1998

[54] DUAL PAGE PRINTED MATERIAL SLEEVE AND STORING DEVICE

[76] Inventor: Andrea Balbas, 380 Wales Dr., #D, Folsom, Calif. 95630

[21] Appl. No.: 703,010

[22] Filed: Aug. 26, 1996

[51] Int. Cl.[6] ..... B42D 3/04

[52] U.S. Cl. ..... 281/19.1; 281/29; 281/31

[58] Field of Search ..... 281/19.1, 29, 36, 281/38, 31, 51, 45; 462/79, 73, 70

[56] References Cited

U.S. PATENT DOCUMENTS

| | | | |
|---|---|---|---|
| D. 311,208 | 10/1990 | Folson | D19/27 |
| 4,810,544 | 3/1989 | Hickman | 402/79 X |
| 4,824,273 | 4/1989 | Silva et al. | 402/79 |
| 4,925,720 | 5/1990 | Hansen | 402/79 X |
| 5,029,900 | 7/1991 | Axelrod | 281/29 X |
| 5,329,324 | 7/1994 | Candido | 353/120 |
| 5,417,509 | 5/1995 | Schwartz | 402/79 |
| 5,466,008 | 11/1995 | Ozeki | 281/31 |
| 5,472,237 | 12/1995 | Rajeswaran | 281/19.1 |

*Primary Examiner*—Willmon Fridie, Jr.

[57] ABSTRACT

A dual paged printed material storing device (201) that is made up of several transparent sleeves (202). The sleeves are made of two sheets (212, 210) connected to create a bag-shaped cover that is closed on at least three edged portions. The sleeve (202) contains an insertion opening (216) for the insertion of printed material (214). The sleeves are folded in the center in order to create a folder or greeting card type structure as to accommodate a greeting card or other printed material of the like. The sleeves (202) may be permanently binded to a binder type cover (204). They may also be produced in a manner that allows them to be stored and easily removed from a ringed binder. Sleeves (202) for a ringed binder have a tab (222) across the back sheet (210) that contains holes (220).

20 Claims, 9 Drawing Sheets

DUAL PAGE PRINTED MATERIAL SLEEVE AND STORING DEVICE

BACKGROUND

1. Field of the Invention

This invention relates to printed material protection sleeves and storing devices for the like, specifically printed material protection sleeves that are used to cover dual page or greeting card-like materials.

2. Description of Prior Art

Original sheet covers have the ability to cover and display only one sheet or single page material. Dual page and greeting card-like materials need to be placed in sheet covers while in their folded position. Storing these materials in their folded position prohibits the open display of their contents. In order to view the open display of greeting card-like or dual page materials that are stored in modern-day sheet covers, it is necessary to remove them from the sheet cover.

Today's sheet covers are produced in double size with a fold to accommodate dual paged materials. However, the display of such materials is inconsistent with how the dual paged materials are viewed independent of such sheet covers. Dual paged printed materials are designed in a manner that considers the process in which they are viewed. When the design of a dual paged printed material is created, it is done so with the expectation that the viewer will first see the cover page, then open/inside display, and finally the back of the dual paged printed material. A sheet cover that requires that the viewing process of dual paged printed materials be altered takes away from the design of the product as it was meant to impact its viewers. The viewing of dual paged printed materials in a way other than their intended viewing process is awkward and confusing. There are no sheet covers currently available that have binding means along a fold in order to properly display dual paged materials.

Storage of materials in sheet covers is done for aesthetic display as well as for protection and preservation of the stored materials. Therefore, every time a material is removed from its cover, there is a potential for a loss of quality in the given material. With the necessity to remove material from a sheet cover in order to fully view its contents the integrity of the sheet cover and its purpose is lessened. Every time a material is removed from its sheet cover, there is the possibility that it may be damaged. Furthermore, when the material is removed from the sheet cover the aesthetic attributes of the sheet cover are lost. The aesthetic attributes that a sheet cover may add to the covered material are; shine or luster, thickness, consistency of color, and brightness of color.

All prior produced or invented sheet covers are not designed in a manner that allows them to adequately and properly display dual page or greeting card-like material. The limited abilities of prior sheet covers allow for only partial display and inadequate protection of dual page or greeting card-like materials.

OBJECTS AND ADVANTAGES

Accordingly, several objects and advantages of my invention are:

(a) to provide protection for dual paged printed material without altering its physical condition;

(b) to add aesthetic qualities such as, luster and thickness to any item being stored in the sleeve (c) to provide a display for printed material which is easy to assemble and design (d) to provide complete and thorough protection for dual page printed material while still in its physically complete and connected format (e) to provide a sleeve for dual paged printed material that allows for its open and complete display while remaining completely covered (f) to provide a sleeve that maybe used in any type of binder that allows for its easy removal and replacement by the use of holes for rings or any other assembling strategy (g) to provide a sleeve that maybe permanently binded in a binder or other book-like covering through any permanently binding procedure (h) to provide a transparent sleeve that allows for the complete display of single paged as well as dual paged printed material (i) to provide a transparent sleeve that keeps the inserted printed material stable and secure as to not slip or fall out of the sleeve (j) to provide binding means along the fold as to maintain the integrity of the viewing process for dual paged printed materials.

Still further objects and advantages will become apparent from a consideration of the ensuing description and accompanying drawings.

REFERENCE NUMERALS

Figure 1:
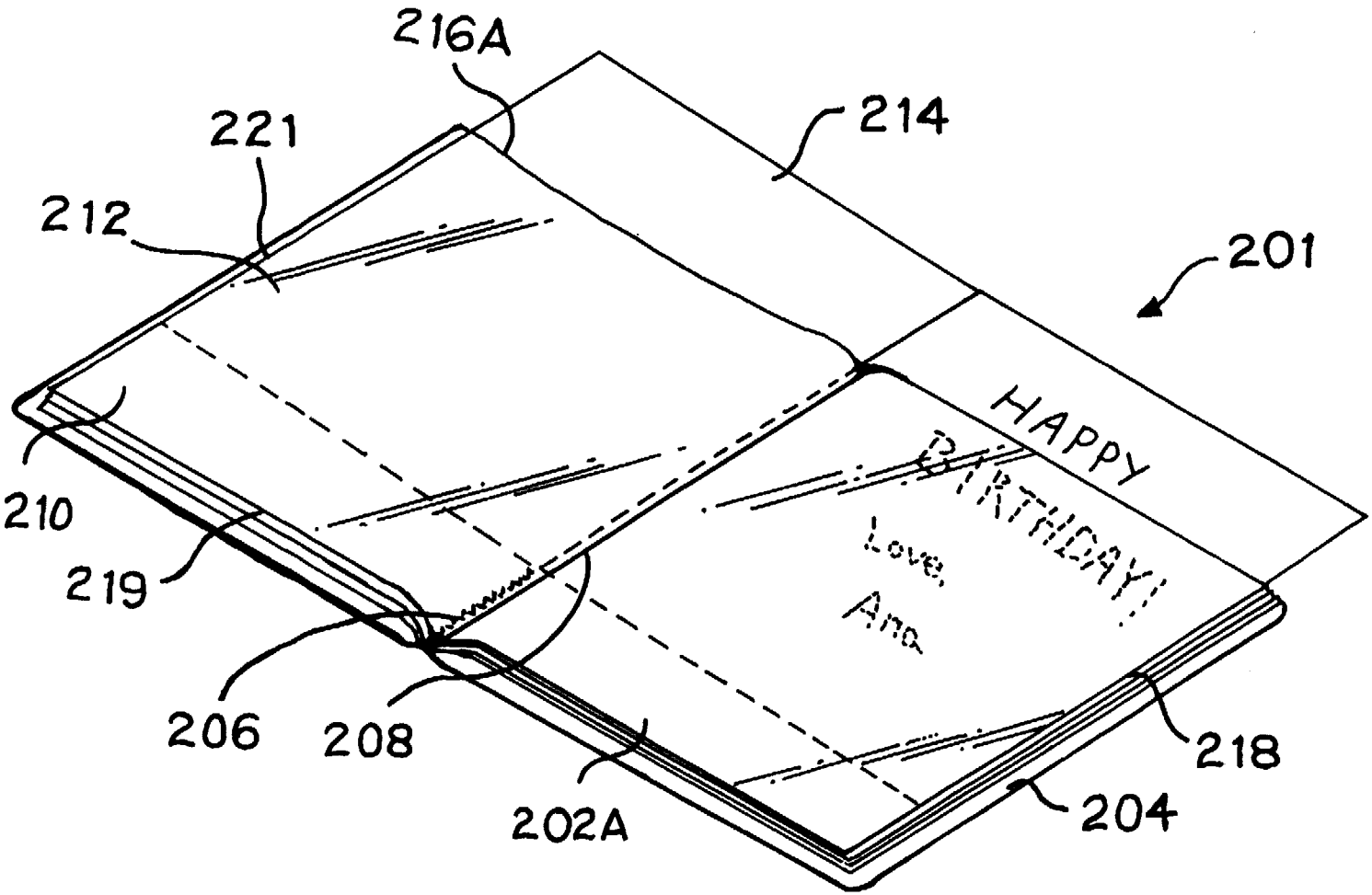
FIG. 1 is a perspective view of a transparent, dual paged printed material protection sleeve and storing device in accordance with one embodiment of the present invention.

201 dual paged printed material storing device

202A sleeve

202B sleeve

202C sleeve
202D sleeve
202E sleeve
204 binder type cover
206 binding means
208 crease
210 back sheet
212 front sheet
214 dual paged printed material sample
216A insertion opening
216B insertion opening
216C insertion opening
216D insertion opening
218 right edge
219 bottom edge
220 holes
221 left edge
222 tab
223 top edge
224A flap
224B flap
226A welding line
226B welding line
228 seam

SUMMARY

A printed material storing device made up of transparent sleeves. The transparent sleeves are folded in half in order to produce a dual paged effect in order to provide a thorough cover for dual paged printed material. The transparent sleeves may be binded to a binder type cover or have means to by stored in a ringed binder.

PREFERRED EMBODIMENT—DESCRIPTION

Figure 2:
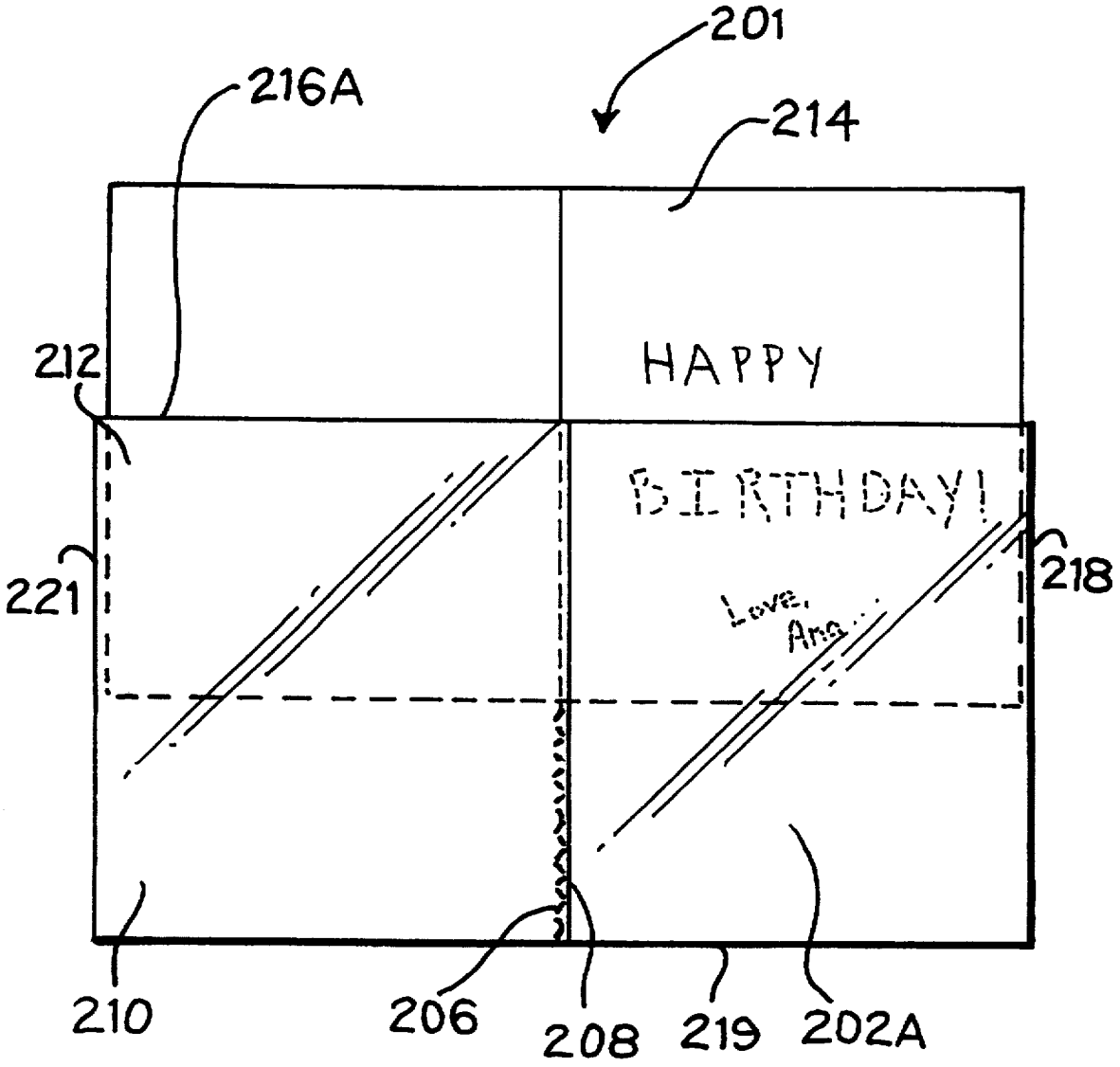
FIG. 2 is a front view of the transparent, dual paged printed material protection sleeve shown in FIG. 1.

Referring to the drawings, particularly to FIGS. 1 and 2, there is shown a first embodiment of the present invention. In FIG. 1, there is a dual paged printed material sample 214, specifically, a greeting card. The greeting card is an example of one of many dual paged printed material products that may be stored in the present invention.

There is provided a dual paged printed material storing device 201, which is made up of rectangular sleeves 202A made of transparent material. A good example of a flexible transparent material suitable for the production of the protection sleeves is Vinyl, however; many other materials may also be suitable. The sleeve is formed at one side edge portion with an insertion opening 216A for inserting dual paged printed material 214. A front sheet 212 of sleeve 202A contains a crease 208. Crease 208 is formed perpendicular to insertion opening 216A and in the center of and parallel to the two side edge portions 218 A and 218 C. Therefore, crease 208 divides front sheet 212 perfectly in half. A right edge 218 is closed, front sheet 212 being connected to back sheet 210. The bottom edge and left edges 219 and 221 are also close by front and back sheets 212, 210 being connected. Back sheet 210 contains abinding means 206 for binding sleeve 202A in a book-like binder. The aforementioned specifications create a bag-like structure, folded in half. There are no connections between front sheet 212 and back sheet 210 except for on their aforementioned edged portions. The structure of protection sleeve 202A is similar to that of a folder or greeting card with the difference of having a pocket or sleeve type value. It will be understood in FIG. 1 that a plurality of similar sleeves 202A storing dual paged printed material 214 are bound in the same book type storing device 201, having a binder type cover 204.

In the embodiment shown in FIGS. 1 and 2, the binding means 206 is formed by bonding a desired number of covers such as by welding or sealing one sleeve 202A to another.

PREFERRED EMBODIMENT—OPERATION

The manner of using a dual paged printed material storing device 201 is similar to that of a photo album. The dual paged printed material storing device 201 is used to stored printed material 214 of your choice. Printed material 214 can be removed from and replaced easily into the dual paged printed material storing device 201. The dual paged printed material storing device 201 contains sleeves 202A that are used to cover, protect, store, and display individual pieces of printed material. The sleeves 202A are connected together and further to a binder type cover 204 by binder means 206. The binder type cover 204 is used to store and protect the sleeves 202A. The binder type cover 204 gives the device 201 a book-like quality. The device 201 can be opened and closed.

The sleeves 202A are used as transparent display covers for printed material 214. Each sleeve 202A has one insertion opening 216A in order to allow for the insertion of printed material 214. Each sleeve 202A also has three closed edges 218, 219, 221 in order to keep the printed material 214 from slipping or falling out of the sleeve. The back sheet 210 of each sleeve 202A contains binding means 206 to keep the sleeve 202A attached to the device 201. The binding means 206 is directly in the center of the two side edges 218 and 221. The front sheet 212 of the sleeve 202A contains a crease 208 that allows for the sleeve to fold or close easily. The crease 208 is directly in the center of the two side edges 218 and 221. The combination of the placement of the crease 208 and the binding means 206, gives the sleeve 202A a folder-type quality. Finally, this product is perfect for the storage of dual paged printed material materials such as, greeting cards and folder—type brochures because it allows for their open as well as closed display.

OTHER EMBODIMENTS

Side Edge Insertion Opening—Description

Figure 3:
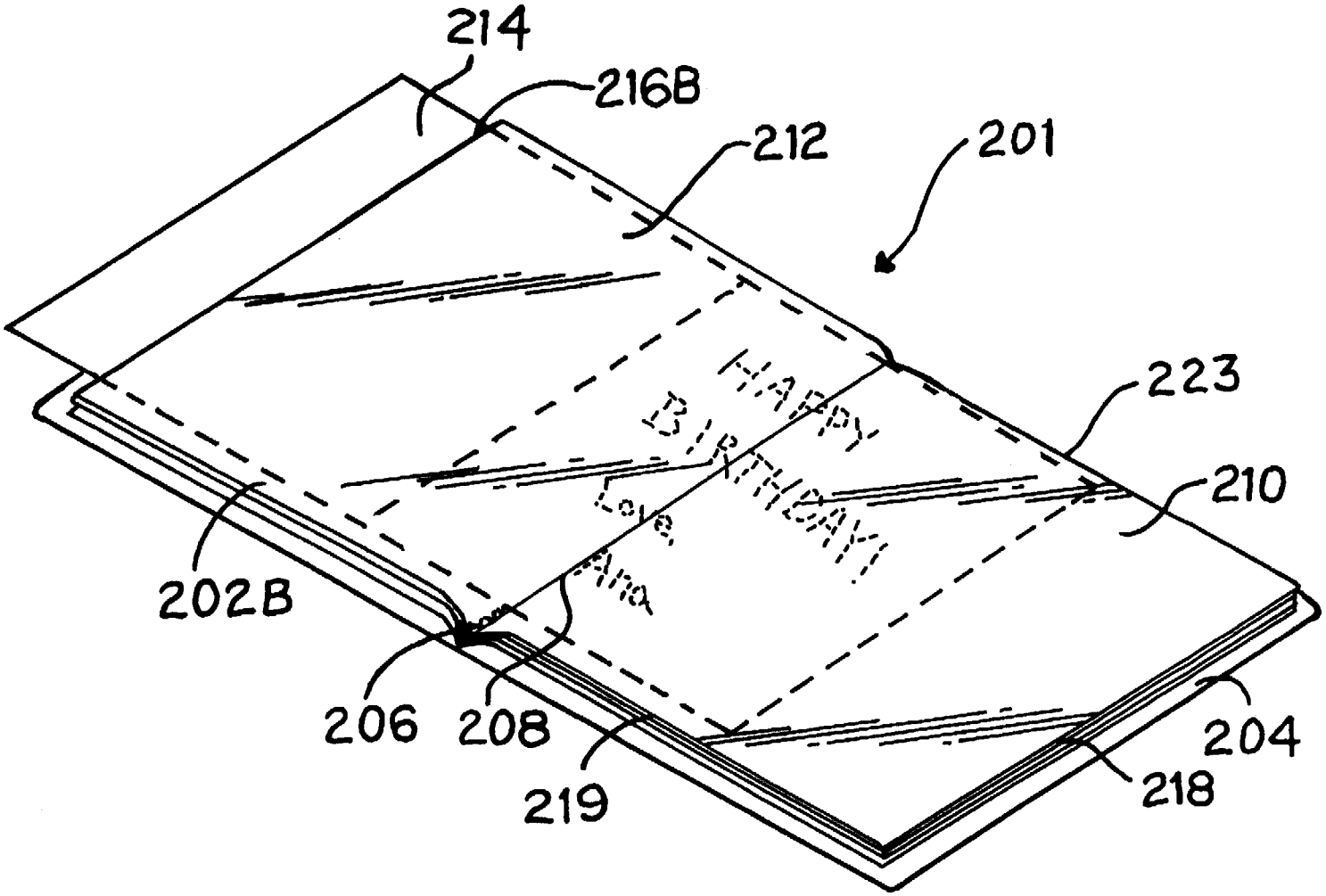
FIG. 3 is a perspective view of a transparent, dual paged printed material protection sleeve in accordance with another embodiment of the present invention.
Figure 4:
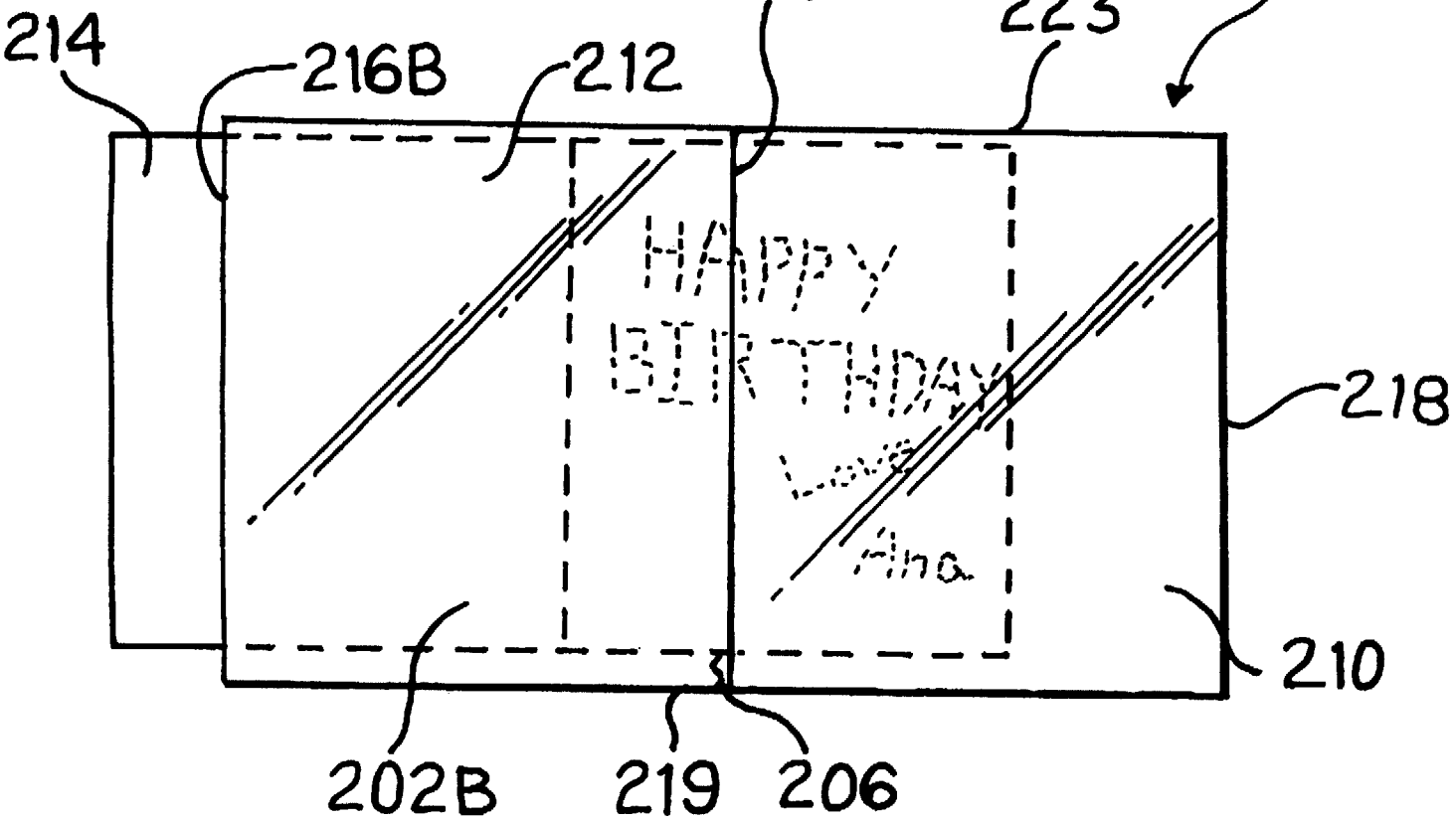
FIG. 4 is a front view of the transparent, dual paged printed material protection sleeve shown in FIG. 3.

Referring now to FIGS. 3 and 4, there is shown a second embodiment of the present invention that is substantially identical except that the sleeve 202B is formed with an insertion opening 216B at either side parallel to the binding means 206 and crease 208. All remaining three edges are closed by front sheet 212 edges being connected to the back sheet 210 edges; top edge 223, bottom edge 219, and right edge 218. In other respects, the structure is the same as in the previous embodiment so that detailed descriptions will be omitted.

Side Edge Insertion Opening—Operation

In FIGS. 3 and 4 the operation is slightly different from in FIGS. 1 and 2. In FIGS. 3 and 4 the material 214 is inserted from the side rather than the top due to the placement of the insertion opening. In other respects, the operational features are the same as in the previous embodiment.

Horizontal Flap Insertion Opening—Description

Figure 5:
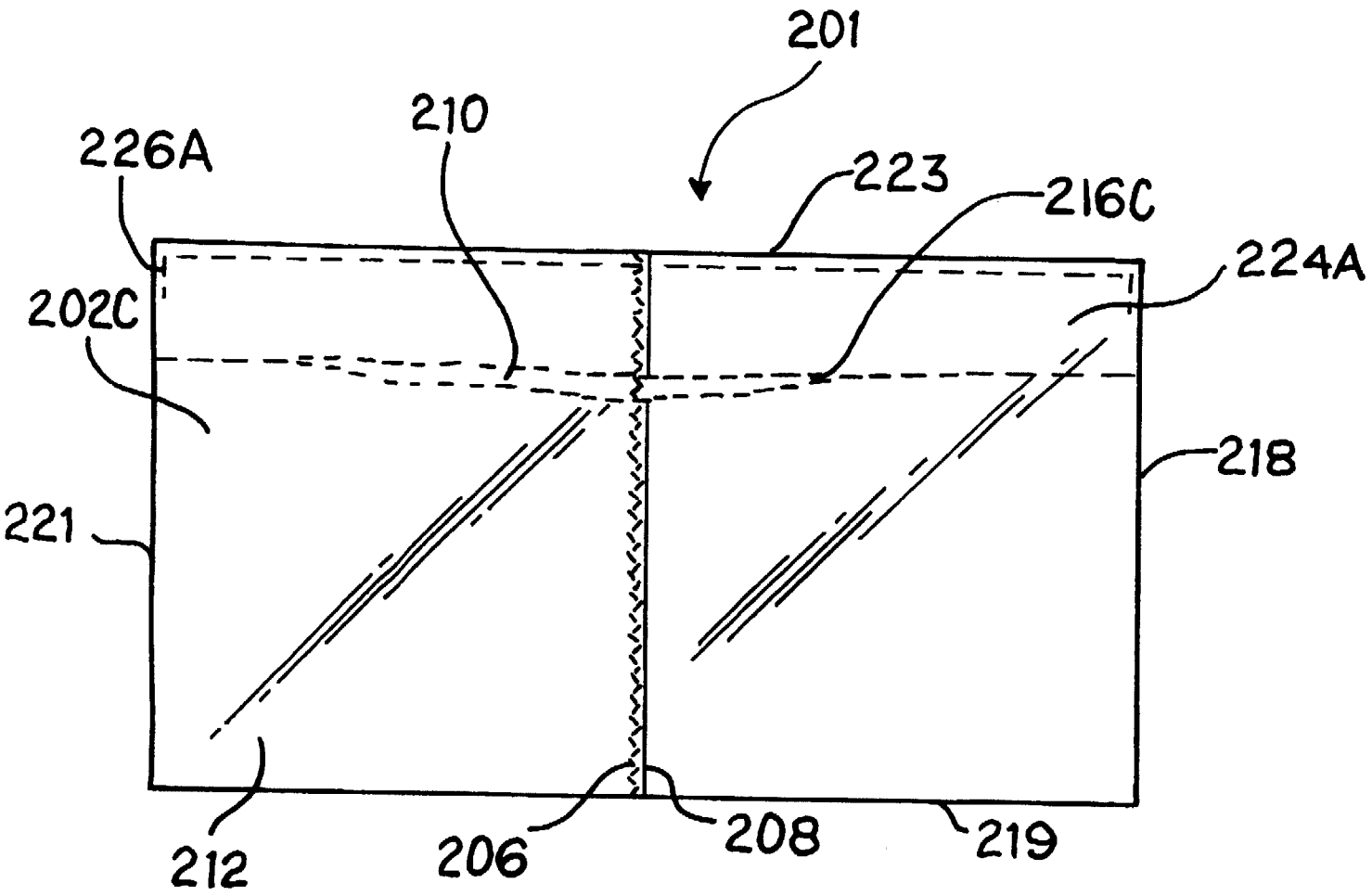
FIG. 5 is a front view of a transparent, dual paged printed material protection sleeve with still another embodiment of the present invention.
Figure 6B:
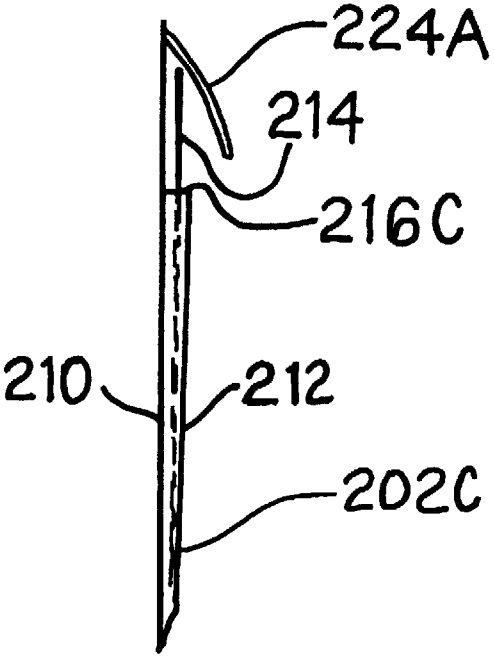
FIG. 6B is a fragmentary side view similar to FIG. 6A but showing a dual paged printed material sheet completely inserted into the sleeve.
Figure 6A:
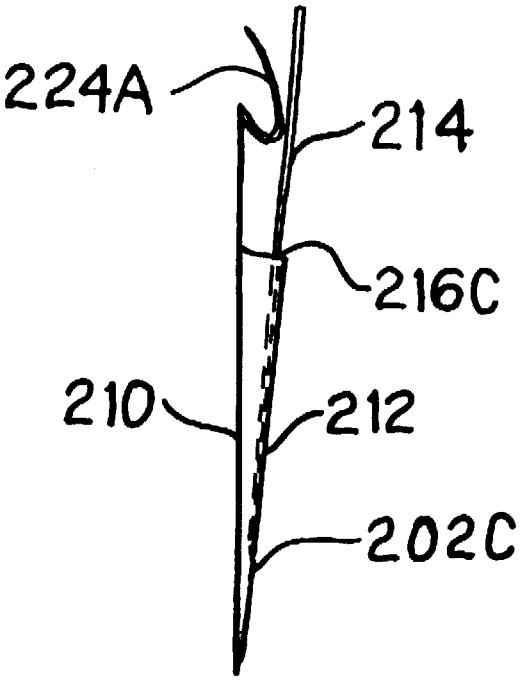
FIG. 6A is a fragmentary side view of the dual paged printed material protection sleeve shown in FIG. 5 with a dual paged printed material sheet being in a stage of insertion.

Referring to FIGS. 5 and 6 that show a third embodiment of the present invention, a sleeve 202C of this embodiment includes an insertion opening 216C formed at a portion offset from an edge portion of the sleeve 202C by a predetermined distance toward the top edge 223. As shown in FIG. 6, sleeve 202C is formed by front sheet 212 and back sheet 210. Front sheet 212 is shorter than back sheet 210 so that front sheet 212 at the upper edge portion is located a certain distance lower than the upper edge portion of the back sheet 210 to form the aforementioned insertion opening 216C. Also in FIG. 6A, back sheet 210 is provided at the upper end portion with a flap 224A for covering a portion of the printed material 214 which projects beyond the upper edge portion of front sheet 212. Flap 224A is connected to back sheet 210 by welding along a welding line 226A as shown in FIG. 5.

As shown in FIG. 5 welding line 226A is extended at the opposite end portions along side edge portions of back sheet 210. With this configuration of welding line 226A, flap 224A is biased toward downward as shown in FIG. 6A and 6B. The insertion opening 216C in FIGS. 5 and 6 is not on any edge of the sleeve. Thus, leaving edges 218, 219, 221, and 223 closed.

In other respects the structure is the same as in the previous embodiments so that detailed descriptions will be omitted.

Horizontal Flap Insertion Opening—Operation

All operational features in FIGS. 5 and 6 are similar to the other embodiments except that the insertion of printed material 214 would call for the correct adjustment of flap 224A.

Vertical Flap Insertion Opening—Description

Figure 7:
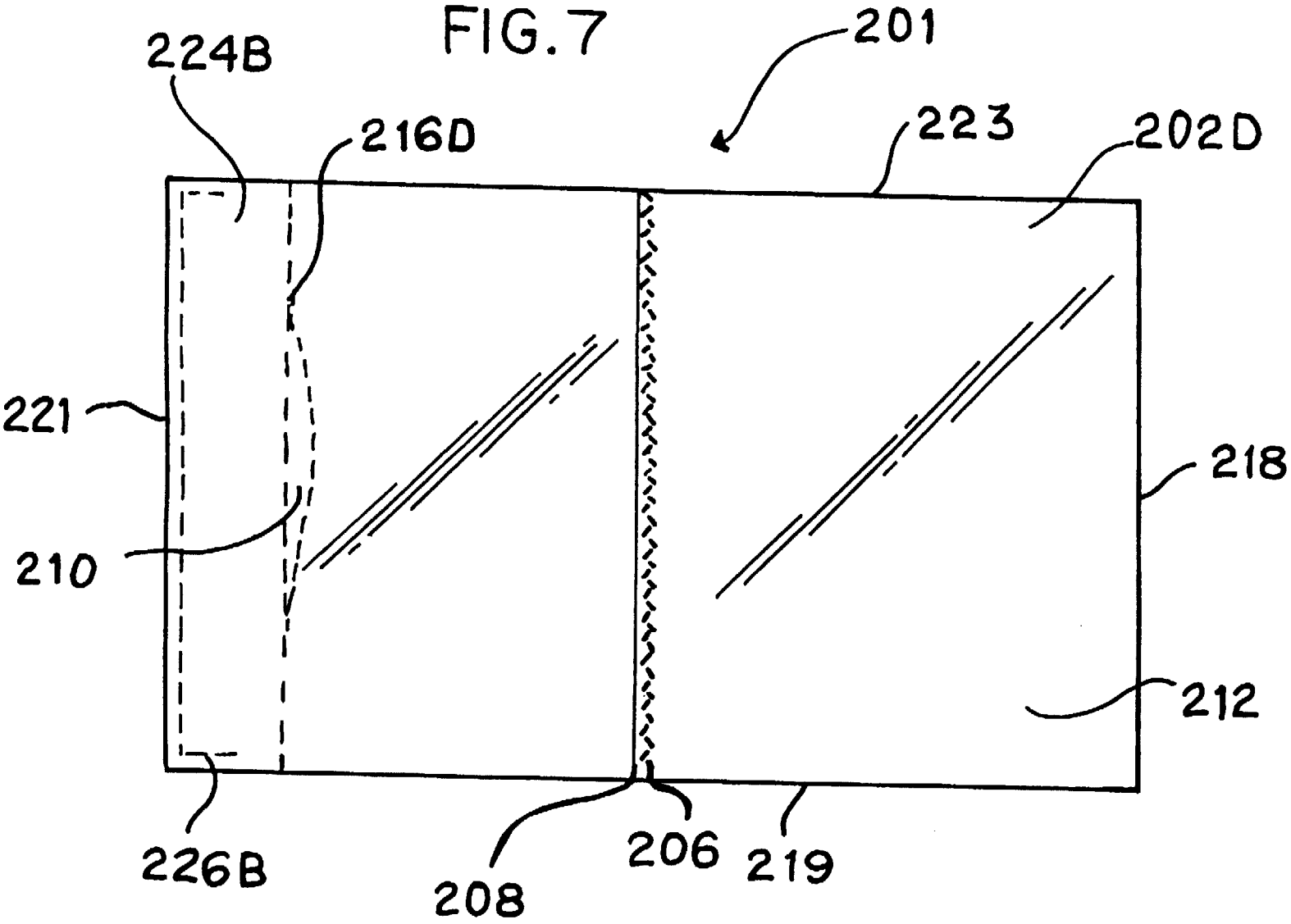
FIG. 7 is a front view showing a transparent, dual paged printed material protection sleeve with a further embodiment of the present invention.

Referring to FIG. 7 there is shown a further embodiment of the present invention. In this embodiment, a sleeve 202D is formed with an insertion opening 216D at a side parallel to the side where a binding means 206 is formed. As in the previous embodiment shown in FIGS. 5 and 6, a front sheet of the sleeve 212 is smaller in width than the back sheet 210 so that a insertion opening 216D is offset sidewardly from the outer side edge of the sleeve 202D. A flap 224B is formed at a outer side portion of sleeve 202D and attached to the adjacent edge of a back sheet 210 along a welding line 226B similar to that of the flap 224B in the previous embodiment.

Vertical Flap Insertion Opening—Operation

The operational features of sleeve 202D illustrated in FIG. 7 are similar to those in the previous embodiments except for the side insertion that calls for the adjustment of flap 224B.

Sleeve for a Ringed Binder—Description

Figure 8:
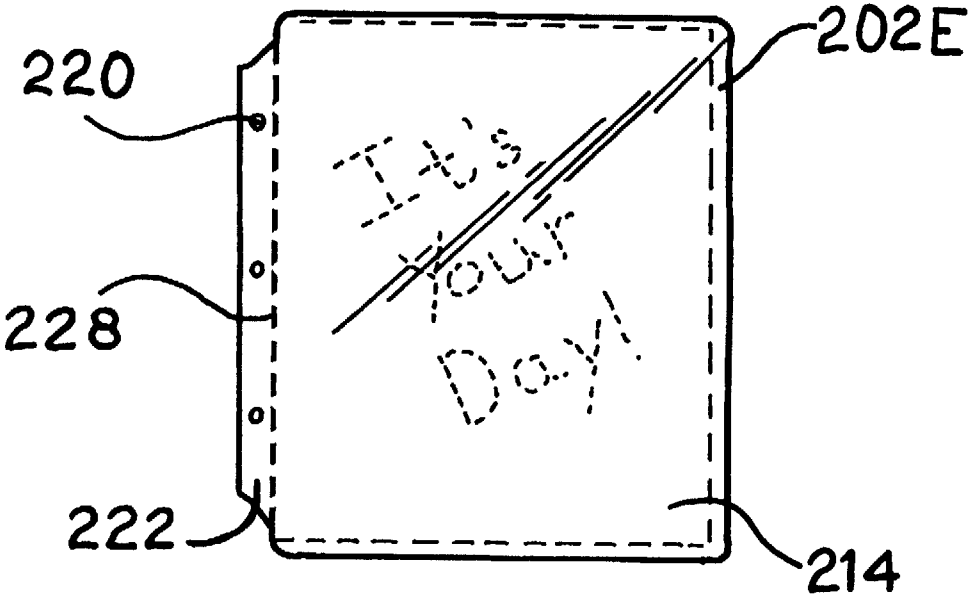
FIG. 8 is a front view of a transparent, dual paged printed material protection sleeve, independent of a book-like storage device, in the closed position with a dual paged printed material sheet completely inserted.
Figure 9:
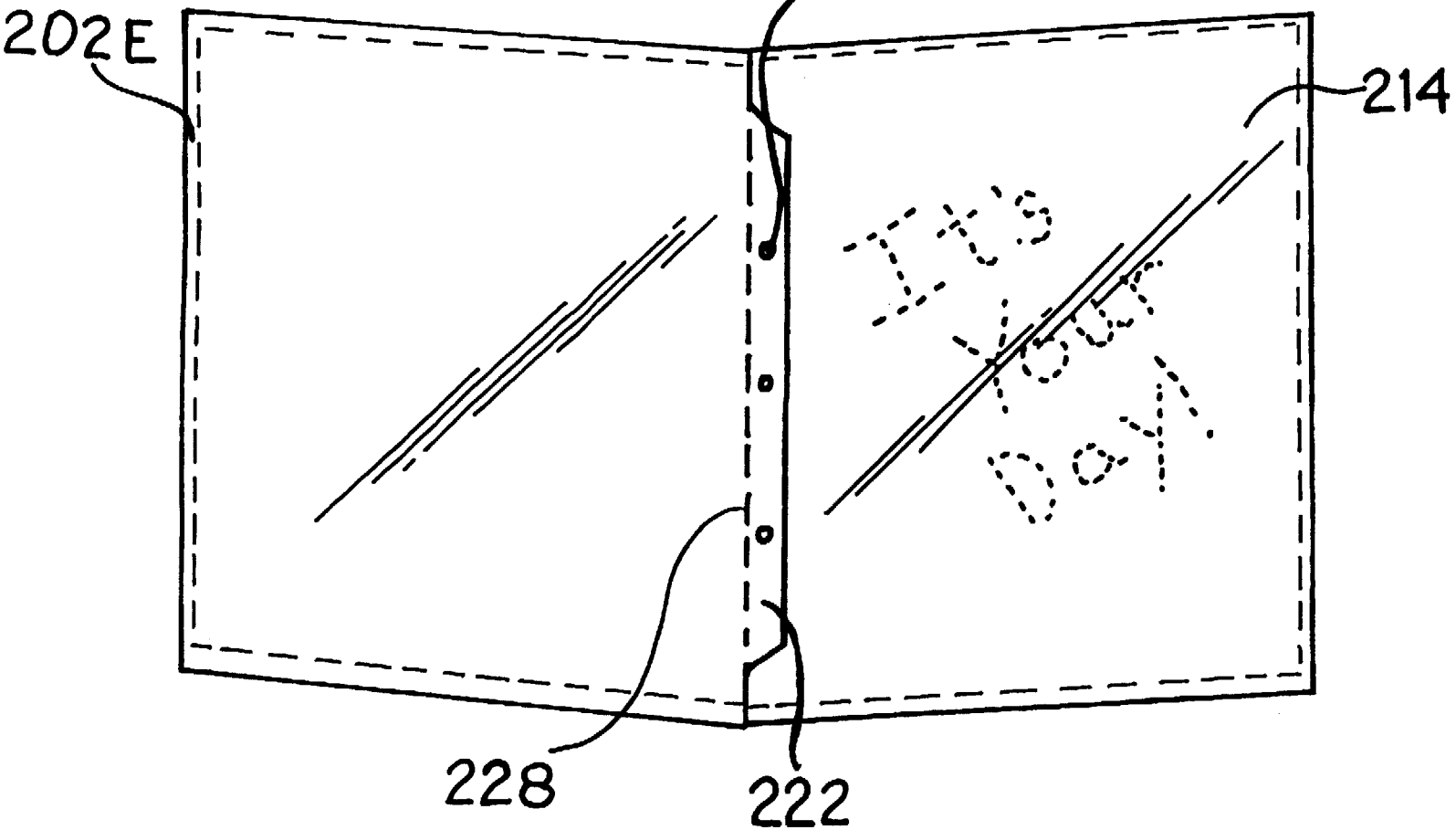
FIG. 9 is a back view of a transparent, dual paged printed material protection sleeve, independent of a book-like storage device, in the open position with a dual paged printed material sheet completely inserted.

In FIGS. 8 and 9 a further embodiment of the present invention is presented. FIG. 8 shows a sleeve 202E independent of a binder type storage device 201 as shown in previous embodiments. In FIG. 8 sleeve 202E and printed material 214, being completely inserted into sleeve 202E are in the closed position. A tab 222 may contain many holes 220 as to make such sleeve 202E suited for storage in a ringed binder. Sleeve 202E is separated from tab 222 by a seam 228 that may be produced by welding. Seam 228 separates printed material 214 from the direct contact to a ringed binder. Seam 228 prevents printed material 214 from sliding around in sleeve 202E and becoming damaged. FIG. 9 is a back view of the embodiment in FIG. 8 displayed in the open position. Any of the previous embodiments may be produced with tab 222 as to make them suited for a ringed binder rather than a permanent binding structure.

Sleeve for a Ringed Binder—Operation

The operation of sleeve 202E is similar to that of the other embodiments except that sleeve 202E may be easily placed and removed from a ringed binder.

CONCLUSIONS, RAMIFICATIONS, AND SCOPE

Accordingly, it can be seen that the dual paged printed material storage device can be used to store dual paged printed material such as greeting cards in their complete physical form. The sleeves allow for the display of dual paged printed material in their open and close positions while still covered by the sleeve. The sleeves of the device thoroughly protect and display any printed material stored in them. Printed material may be inserted and removed easily from the sleeves. The sleeves may be binded to a storage device or produced to be accommodated in a ring binder.

Although the description above contains many specificities, these should not be construed as limiting the scope of the invention but as merely providing illustrations of some of the presently preferred embodiments of this invention. Various other embodiments and ramifications are possible within it's scope. For example, the storage device and sleeves may be of any size to accommodate any sized printed material. The materials used to produce the sleeves may vary as to have different textures and clearness. The device as well as the sleeves may have added aesthetic attributes to add to their overall aesthetic display.

Thus the scope of the invention should be determined by the appended claims and their legal equivalents, rather than by the examples given.

What is claimed is:

1. A storing device, for a printed material consisting of at least one fold, the storage device comprising:

a. a transparent pocket enclosure comprising a transparent back cover and a transparent front cover, each of said covers comprising an outer face and inner face, said front cover comprising an upper edge, a lower edge, and two lateral edges, said upper edge, said lower edge, and said lateral edges forming a periphery of said front cover, said back cover comprising a top edge, a bottom edge, and two side edges, said top edge, said bottom edge, and said side edges forming a perimeter of said back cover, said back cover further having a crease extending between said top edge and said bottom edge, said front cover being coupled to said back cover between, at least a portion of said perimeter and at least a portion of said periphery;

b. said pocket enclosure totally open between said front cover and said back cover;

c. a means to insert the printed material consisting of at least one fold into said pocket;

d. a binding means adjacent to said crease of said back cover; and e. said pocket enclosure located between said inner faces of said back and said front covers, said pocket including a fold region where said back cover and any said printed material can fold.

2. The pocket enclosure of claim 1, wherein said back cover and said front cover are detached at one of said side edges and said lateral edges whereby said printed material may be inserted.

3. The pocket enclosure of claim 1, wherein said back cover and said front cover are detached at said top edge and said upper edge whereby said printed material may be inserted.

4. The pocket enclosure of claim 1, wherein said back cover and said front cover are detached at said bottom edge and said lower edge whereby said printed material may be inserted.

5. The pocket enclosure of claim 1, wherein said back cover comprises an opening whereby said printed material may be inserted.

6. The pocket enclosure of claim 1, wherein said front cover comprises an opening whereby said printed material may be inserted.

7. The pocket enclosure of claim 1, wherein said pocket is permanently bound to a rigid opaque cover.

8. The pocket enclosure of claim 1, wherein said binding means includes a plurality of holes for use with a ringed binder type of said cover.

9. The pocket enclosure of claim 1, wherein said back cover includes a spine for use when binding.

10. The pocket enclosure of claim 1, wherein said front cover and said back cover are of the same size and shape.

11. The pocket enclosure of claim 1, wherein said side edges are parallel to one another and said lateral edges are parallel to one another.

12. A storing device, for folded printed material, comprising:

a. a transparent pocket enclosure including a transparent back cover and a transparent front cover, said covers having an outer face and inner face, said front cover having an upper edge, a lower edge, and two lateral edges, said upper edge, said lower edge, and said lateral edges forming a periphery of said front cover, said front cover further having a folded portion extending between said upper and lower edges, said back cover having a top edge, a bottom edge, and two side edges, said top edge, said bottom edge, and said side edges forming a perimeter of said back cover, said back cover further having a crease extending between said top edge and said bottom edge, said front cover being coupled to said back cover at, at least a portion of said perimeter and at least a portion of said periphery, said folded region overlying said crease;

b. said pocket enclosure totally open between said front cover and said back cover;

c. a means to insert the folded printed material into said pocket;

d. a binding means adjacent to said crease; and e. said pocket enclosure between said inner faces of said back and said front covers, said pocket including said crease region and said folded portion where said back cover, said front cover and any said printed material can fold.

13. The pocket enclosure of claim 12, wherein said front cover and said back cover are detached at one of said side edges and said lateral edges whereby said printed material may be inserted.

14. The pocket enclosure of claim 12, wherein said back cover and said front cover are detached at said top edge and said upper edge whereby said printed material may be inserted.

15. The pocket enclosure of claim 12, wherein said back cover and said front cover are detached at said bottom edge and said lower edge whereby said printed material may be inserted.

16. The pocket enclosure of claim 12, wherein said back cover comprises an opening whereby said printed material may be inserted.

17. The pocket enclosure of claim 12, wherein said front cover comprises an opening whereby said printed material may be inserted.

18. The pocket enclosure of claim 12, wherein said pocket is permanently bound to a rigid opaque cover.

19. The pocket enclosure of claim 12, wherein said binding means includes a plurality of holes for use with a ringed binder type of said cover.

20. The pocket enclosure of claim 12, wherein said back cover includes a spine for use when binding.

* * * * *